US010443583B2

(12) United States Patent
Rath et al.

(10) Patent No.: US 10,443,583 B2
(45) Date of Patent: Oct. 15, 2019

(54) VIBRATORY DRIVE WITH HYDRAULIC PULSE GENERATOR

(71) Applicant: Robert Bosch GmbH, Stuttgart (DE)

(72) Inventors: Andreas Rath, Kefermarkt (AT); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 294 days.

(21) Appl. No.: 15/360,827

(22) Filed: Nov. 23, 2016

(65) Prior Publication Data

US 2017/0145991 A1 May 25, 2017

(30) Foreign Application Priority Data

Nov. 23, 2015 (DE) ..... 10 2015 223 037

(51) Int. Cl.
*F04B 1/20* (2006.01)
*F04B 1/12* (2006.01)
(Continued)

(52) U.S. Cl.
CPC ..... *F04B 1/128* (2013.01); *F04B 1/14* (2013.01); *F04B 1/146* (2013.01); *F04B 1/20* (2013.01);
(Continued)

(58) Field of Classification Search
CPC ..... F15B 15/18; F15B 2211/7054; F15B 2211/7053; F15B 2211/20561; F04B 1/20;
(Continued)

(56) References Cited

U.S. PATENT DOCUMENTS 3,115,751 A * 12/1963 McGee ..... F04B 1/122 60/379
3,633,467 A 1/1972 Watanabe et al.
(Continued)

FOREIGN PATENT DOCUMENTS

DE 884 173 C 8/1953
DE 36 857 A 4/1965
(Continued)

OTHER PUBLICATIONS

German Search Report corresponding to German Application No. 10 2015 223 037.6, dated Aug. 23, 2016 (7 pages).

*Primary Examiner* — Charles G Freay
*Assistant Examiner* — Thomas Fink
(74) *Attorney, Agent, or Firm* — Maginot, Moore & Beck LLP

(57) ABSTRACT

A vibratory drive includes a pulse generator and at least one actuator. The actuator includes a first fluid chamber and a second fluid chamber, the volumes of which are adjustable in phase opposition. The first fluid chamber has a fluid connection to a third fluid chamber in the pulse generator. The second fluid chamber has a fluid connection to a fourth fluid chamber in the pulse generator. The third and fourth fluid chambers each have portions that are defined by linearly moveable defining elements. The pulse generator includes a rotor that rotates relative to a first axis of rotation and that defines respective portions of the third fluid chamber and the fourth fluid chamber. The defining elements are linearly moveable in the rotor. The pulse generator includes a coupling element that is separate from the rotor. The defining elements are coupled in their movement to that of the coupling element.

10 Claims, 5 Drawing Sheets

(51) Int. Cl.

| | |
|---|---|
| ***F04B 1/14*** | (2006.01) |
| ***F04B 9/109*** | (2006.01) |
| ***F04C 2/344*** | (2006.01) |
| ***F04C 15/00*** | (2006.01) |
| *F04C 15/06* | (2006.01) |

(52) U.S. Cl.
CPC ..... *F04B 9/109* (2013.01); *F04C 2/344* (2013.01); *F04C 15/0061* (2013.01); *F04C 15/06* (2013.01)

(58) Field of Classification Search
CPC ..... F04B 1/2042; F04B 1/2078; F04C 15/06; F04C 2/344
See application file for complete search history.

(56) References Cited

U.S. PATENT DOCUMENTS 3,680,652 A * 8/1972 Greene ..... B60K 17/356 180/22
4,068,595 A 1/1978 Weber et al.
5,144,801 A * 9/1992 Scanderbeg ..... F15B 15/18 60/475
5,181,844 A * 1/1993 Bishop ..... F01C 21/0809 418/152
2004/0126245 A1* 7/2004 Folsom ..... F04B 1/124 417/269
2011/0271828 A1* 11/2011 Roth ..... F01B 3/0088 92/13
2014/0119969 A1* 5/2014 Iijima ..... F04C 2/344 418/30

FOREIGN PATENT DOCUMENTS

DE 36857 A1 * 4/1965
FR 1212419 A 3/1960
GB 1 005 144 9/1965
GB 1 475 144 6/1977
GB 1475144 A1 * 6/1977

* cited by examiner

VIBRATORY DRIVE WITH HYDRAULIC PULSE GENERATOR

This application claims priority under 35 U.S.C. § 119 to patent application no. DE 10 2015 223 037.6, filed on Nov. 23, 2015 in Germany, the disclosure of which is incorporated herein by reference in its entirety.

BACKGROUND

The disclosure relates to a vibratory drive.

FR 1 212 419 A discloses a vibratory drive, which comprises a total of four actuators, which are each formed from two opposed, single-acting cylinders, so that they each comprise a first fluid chamber and a second fluid chamber. A pulse generating means is furthermore provided, which is embodied in the form of a piston pump, which has a crankshaft and which comprises a total of four third and four fourth fluid chambers. Each first fluid chamber has a fluid connection to an assigned third fluid chamber. Each second fluid chamber has a fluid connection to an assigned fourth fluid chamber.

An advantage of the present disclosure is that it can be operated at a particularly high pressure. Furthermore, the swept volume of the pulse generating means can be easily adjusted, so that the vibration intensity of the vibratory drive is adjustable.

SUMMARY

It is proposed according to the disclosure that the pulse generator comprise a rotor, which is capable of rotating relative to a first axis of rotation and which defines respective portions of the at least one third fluid chamber and the at least one fourth fluid chamber, the defining elements being accommodated so that they are linearly moveable in the rotor, the pulse generator comprising a coupling element separate from the rotor, the defining elements being coupled in their movement to that of the coupling element. This substantially simplifies the construction of the pulse generator. In addition, more than two fluid chambers can easily be accommodated in the rotor. As a result, multiple actuators can be supplied in parallel. It is also feasible, however, for multiple third or fourth fluid chambers to be connected in parallel to a first or second fluid chamber. This results in an especially compact pulse generator. The vibratory drive is intended for use with a hydraulic fluid, preferably a liquid and most preferably hydraulic oil. The vibratory drive according to the disclosure can be operated at an especially high hydraulic fluid pressure. The actuator is preferably a linear actuator, for example a hydraulic cylinder, in particular a double-rod cylinder.

Advantageous developments and improvements of the disclosure are specified in the dependent claims.

The position of the coupling element may be adjustable relative to the first axis of rotation. Adjustment of the coupling element serves to adjust the swept volume of the third fluid chamber and the fourth fluid chamber. The vibration intensity of the vibratory drive is thereby adjustable. The position of the coupling element is preferably continuously adjustable. A particular advantage of the vibratory drive according to the disclosure lies precisely in allowing this exceptional ease of adjustment of the vibration intensity. This is just what is lacking in the vibratory drive according to FR 1 212 419 A, for which reason this design is not to be encountered in practice. Instead, vibratory drives of the type in U.S. Pat. No. 4,068,595 A1 are to be found, in which the vibration intensity is adjustable through adjustment of the delivery rate of a pump, the vibratory movement of the actuator being brought about by means of separate valves, which also serve to adjust the vibration frequency. With the vibratory drive according to the disclosure it is possible to dispense with these valves, the vibration intensity and the vibration frequency nevertheless being adjustable. It is to be noted here that the vibration frequency in the vibratory drive according to the disclosure is determined by the rotational speed of the rotor.

The pulse generator may be embodied as an axial piston pump, the defining elements being formed by pistons moving substantially parallel to the first axis of rotation. It will be known to the person skilled in the art that the pistons of an axial piston pump may be arranged inclined at an angle of up to 15° to the first axis of rotation, in order to achieve various functional advantages.

The axial piston pump may be of swash-plate type, the coupling element being formed by a swash plate, which is preferably capable of pivoting relative to a second axis of rotation, the second axis of rotation being oriented perpendicular to the first axis of rotation. The swash plate preferably has a plane coupling face, which is in sliding touching contact with one end of each of the pistons, most preferably in each instance via a hydrostatically supported sliding shoe.

The axial piston pump may be of bent-axis type, the coupling element being formed by a drive shaft, which is rotatable relative to a third axis of rotation, the third axis of rotation intersecting the first axis of rotation, the angle between the first axis of rotation and the third axis of rotation preferably being adjustable. The moving coupling between the drive shaft and each of the pistons is preferably via a ball-and-socket joint, the joint center of which is arranged at a distance from the first axis of rotation.

The pulse generator may be embodied as a vane pump, the defining elements being formed by laminar vanes, linearly moveable in a radial direction to the first axis of rotation, the coupling element being formed by a stroke ring, which surrounds the rotor, limiting the moving travel of the defining elements radially outwards, the stroke ring defining portions of the third fluid chamber and the fourth fluid chamber, the stroke ring preferably being displaceable transversely to the first axis of rotation.

The pulse generator may be embodied as a radial piston pump, the defining elements being formed by pistons moving radially to the first axis of rotation, the coupling element being formed by a stroke ring, which surrounds the rotor, limiting the moving travel of the defining elements radially outwards. The stroke ring may be displaceable transversely to the first axis of rotation. The stroke ring is preferably formed in a known manner so that the pistons perform multiple strokes in one revolution of the rotor. An especially high vibration frequency can thereby be achieved.

The volumes of the at least one third fluid chamber and the at least one fourth fluid chamber, which are assigned to the same actuator, may be adjustable in phase opposition by the rotation of the rotor. The fluid connection of the fluid chambers mentioned above preferably causes an increase in the volume of the first fluid chamber to be accompanied by a reduction in the volume of the assigned third fluid chamber and vice-versa, an increase in the volume of the second fluid chamber being accompanied by a reduction in the volume of the assigned fourth fluid chamber and vice-versa.

A first rotary passage and a second rotary passage in the pulse generator may be assigned to each actuator, each first rotary passage affording a fluid connection from the first fluid chamber concerned to the at least one third fluid chamber concerned, each second rotary passage affording a fluid connection from the second fluid chamber concerned to the at least one fourth fluid chamber concerned. Said fluid connections preferably exist irrespective of the rotational position of the rotor. In the conventional design of the pump types mentioned above there is no such rotary passage. Instead, in a conventional pump a fluid distributor is provided, which, irrespective of the rotational position of the rotor, affords a fluid connection of the third or the fourth fluid chamber either to a high-pressure connection or to a low-pressure connection.

The rotor may be an integral part of all first rotary passages and all second rotary passages. This results in an especially compact vibratory drive, which is moreover easy to manufacture.

The first rotary passage and the second rotary passage may each comprise an annular groove, which runs circularly around the first axis of rotation, an orifice opening, which opens into the annular groove, being arranged on another part of the rotary passage concerned. This affords a fluid exchange connection between the annular groove and orifice opening irrespective of the rotational position of the rotor. The annular groove may be fixedly arranged either on the rotor or on a housing of the pulse generator. The annular groove is preferably of open formation in the direction of the first axis of rotation, so that the orifice opening can open there. It is also feasible, however, for the annular groove to be formed so that it is open radially to the first axis of rotation.

All first rotary passages and all second rotary passages may have a common sealing element, a first sealing face, which bears and slides on a second sealing face on the rotor, being arranged on the sealing element, the first sealing face and the second sealing face being formed so that they are rotationally symmetrical relative to the first axis of rotation. The first sealing face and the second sealing face are preferably plane faces and arranged perpendicular to the first axis of rotation. The sealing element is preferably non-rotatable relative to the first axis of rotation and most preferably in a fixed arrangement.

The annular grooves may be arranged in the one first sealing face or the one second sealing face, the orifice openings being arranged in the other, second or first sealing face. All annular grooves can thereby easily be sealed off together by the sealing engagement between the first sealing face and the second sealing face. Protection is also sought for an embodiment in which at least one, preferably all orifice openings are arranged inside a respectively assigned annular groove. In this embodiment annular grooves are arranged both on the first sealing face and on the second sealing face.

The at least one third fluid chamber and the at least one fourth fluid chamber may each have a fluid connection to an assigned first fluid duct portion, which runs in the rotor and which leads to the assigned rotary passage. The rotary passages preferably have a fluid connection via a second fluid duct portion to the first or second fluid chamber assigned to each of them, the second fluid duct portion most preferably being fixedly arranged in the vibratory drive.

At least two actuators may be provided, to each of which a separate first rotary passage and a separate second rotary passage are assigned, all rotary passages each having an annular groove, all annular grooves being arranged concentrically with one another, two immediately adjacent annular grooves being assigned to each actuator. The annular grooves are preferably arranged in the first sealing face and the second sealing face. The proposed assignment of the annular grooves to the actuators produces a uniform sealing gap between the first sealing face and the second sealing face and consequently minimal leakages.

The number of third fluid chambers and fourth fluid chambers may in each case be a whole-number multiple, greater than one, of the number of actuators, adjacent third fluid chambers in a circumferential direction relative to the first axis of rotation being assigned to the same actuator, adjacent fourth fluid chambers in a circumferential direction relative to the first axis of rotation being assigned to the same actuator. The corresponding vibratory drive has an especially intensive pulsation, the corresponding rotor taking up little overall space. Said multiple selected is preferably the same for the third fluid chamber and the fourth fluid chamber. Said multiple is most preferably two in each case.

It will be obvious that the features specified above and yet to be explained below can be used not only in the particular combination indicated but also in other combinations or in isolation, without departing from the scope of the present disclosure.

BRIEF DESCRIPTION OF THE DRAWINGS

The disclosure is explained in more detail below, referring to the drawings attached, of which.

DETAILED DESCRIPTION

Figure 1:
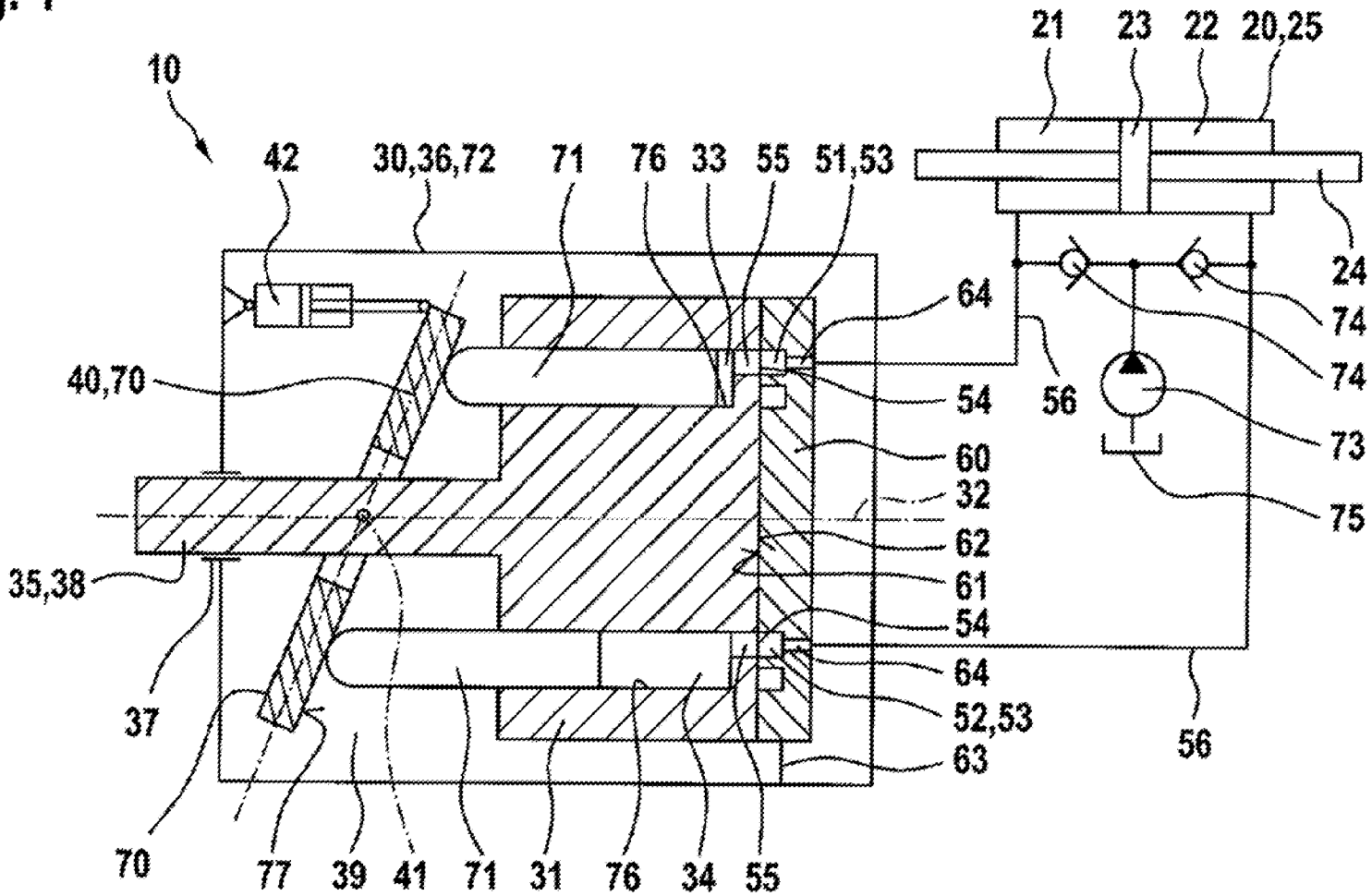
FIG. 1 shows a highly diagrammatic view of a vibratory drive according to a first embodiment of the disclosure.

FIG. 1 shows a highly diagrammatic view of a vibratory drive 10 according to a first embodiment of the disclosure. The vibratory drive 10 here comprises a single actuator 20, it being also possible to use multiple actuators 20. The actuator 20 performs a linear movement, being embodied in the form of a hydraulic double-rod cylinder. It has a first fluid chamber 21 and a second fluid chamber 22, which are defined by a housing 25, a linearly moveable piston 23 and a piston rod 24 fixedly connected to the piston 23. Here the piston rod 24 in any position of the piston 23 passes through the first fluid chamber 21 and the second fluid chamber 22. The volumes of the first fluid chamber 21 and the second fluid chamber 22 vary in phase opposition as the piston 23 slides, that is to say when the volume of the first fluid chamber 21 diminishes, the volume of the second fluid chamber 22 increases, and vice-versa. In the present double-rod cylinder the sum of the volumes of the first fluid chamber 21 and the second fluid chamber 22 is the same in any position of the piston 23. Consequently, the vibratory drive 10 can be embodied substantially in the form of a closed hydraulic circuit. A tank 75 having a reservoir of hydraulic fluid is required solely in order to compensate for leakages. The tank 75 is accordingly of a small design.

The vibratory drive 10 further comprises a pulse generator 30, which here is embodied in the form of an axial piston pump 72, which in turn is of a swash plate-type design. As initially described, other types of hydraulic pump may also be used.

The pulse generator 30 comprises a housing 36, which here is represented highly diagrammatically in the form of an unbroken line. The housing 36 encloses an interior space 39, which is closed so that it is substantially fluid-tight. A rotor 31 is accommodated in the interior space 39. The rotor is supported on the housing 36 by means of one or more pivot bearings 37, so that it can rotate relative to a first axis of rotation 32. The pivot bearing 37 is preferably embodied in the form of a radial antifriction bearing, being designed, for example, as a tapered roller bearing. The rotor 30 comprises a drive shaft 35, which protrudes with a drive journal 38 from the housing 36. The drive journal 38 can be brought into rotational drive connection, for example, with an electric motor or internal combustion engine (not shown), in order to set the rotor 31 in rotational motion, so that the actuator 20 performs a vibratory motion, that is to say a periodically reciprocating motion. The drive shaft 35 may be designed as a separate component, which is rotationally fixed to the rest of the rotor 31. It is also possible, however, to form the rotor 31 in one piece.

Here two linearly moveable defining elements 71, which are arranged at 180° opposite one another relative to the first axis of rotation 32, are accommodated in the rotor 31 and at the same distance from the first axis of rotation 32. The rotor 31 in FIG. 1 is represented in longitudinal section, the plane of section running through the first axis of rotation 32. The defining elements 71 here are embodied as circular cylindrical pistons, which are each received in a fluid-tight matching cylinder bore 76 in the rotor 31. The cylinder bore 76 here is oriented parallel to the first axis of rotation 32, although it may also be arranged slightly inclined in relation to the latter. The defining elements 71 together with the assigned cylinder bore 76 each define a third fluid chamber 33 and a fourth fluid chamber 34. The volumes of the third fluid chamber 33 and the fourth fluid chamber 34 vary in phase opposition as the rotor 31 rotates. Here the sum of the volumes of the third fluid chamber 33 and the fourth fluid chamber 34 is the same in any position of the rotor 31. It is to be noted that yet further pairs of defining elements 71 may be present, which are arranged outside the plane of section in FIG. 1. These pairs may be connected to the present actuator 20 in parallel, it also being feasible for them to be each connected to a further actuator (not shown). These additional pairs of defining elements are preferably identical to the pair of defining elements 71 visible in FIG. 1.

The defining elements 71 each protrude with one end from the rotor 31 in any rotational position of the rotor 31, where they bear and slide on a plane coupling face 77 of the coupling element 70. For the sake of clarity, FIG. 1 shows a direct touching contact between the defining elements 71 and the coupling face 77. It goes without saying that the common sliding shoes, which are hydrostatically supported on the coupling face 77, are used at this point, so as to prevent wear. In the present vibratory drive 10 the known recovery device for the defining elements 71 can generally be dispensed with, since the defining elements 71 extending out of the rotor 31 are in any case pressed against the coupling face 77 by the hydraulic fluid flowing back from the actuator 11.

The coupling element 70 here is embodied in the form of a swash plate, which is pivotally supported relative to a second axis of rotation 41. The second axis of rotation 41 is oriented perpendicular to the first axis of rotation 32, preferably intersecting the latter. The second axis of rotation 41 is thereby oriented perpendicular to the drawing plane in FIG. 1. The plane coupling face 77 is preferably oriented parallel to the second axis of rotation 41. When the rotor 31 is set in rotational motion, the defining elements 71 bear on the coupling face 77 in any rotational position of the rotor 31, so that a rotation of the rotor 31 is accompanied by a stroke movement of the defining elements 71. The angle of inclination of the coupling face 77 to the first axis of rotation 32 can be continuously adjusted, for example by means of a hydraulic swiveling cylinder 42. If the angle between the coupling face 77 and the first axis of rotation 32 is 90°, the defining elements 71 do not perform a stroke movement when the rotor 31 turns. Consequently, the actuator 20 stops. At any other angle a stroke movement of the defining elements 71 occurs. Here the swept volume of the third fluid chamber 33 and the fourth fluid chamber 34 varies as a function of the angle between the coupling face 77 and the first axis of rotation 32.

At the end of the rotor 31 remote from the coupling element 70, a sealing element 60 bears fluid-tightly against the rotor 31. The sealing element 60 is fixedly 63 connected to the housing 36, and may be integrally formed with the housing 36. Preferably, however, a separate laminar sealing element 60 is used, which is fixedly connected to the housing 36. In contrast to a conventional axial piston pump, the sealing element 60 in the present pulse generator is an integral part of a first rotary passage 51 and a second rotary passage 52. The first rotary passage 51 affords the first fluid chamber 21 a fluid connection to the assigned third fluid chamber 33 in any rotational position of the rotor 31. The second rotary passage 52 affords the second fluid chamber 22 a fluid connection to the assigned fourth fluid chamber 34 in any rotational position of the rotor 31. The corresponding fluid connections are preferably designed so that, with the exception of leakages, no hydraulic fluid can escape, there being no valves or other fittings in the fluid path to impede the flow of hydraulic fluid.

Said fluid paths, which are assigned to the first rotary passage 51 and the second rotary passage 52, each comprise a first fluid duct portion 55, an annular groove 53 and a second fluid duct portion 56. The first fluid duct portion runs in the rotor 31, from an assigned cylinder bore 76 to a first sealing face 61 on the rotor 31. The first sealing face 61 is formed so that it is rotationally symmetrical relative to the first axis of rotation 32, and is preferably a plane face and oriented perpendicular to the first axis of rotation 32. The first fluid duct portion 55 preferably opens with an elongated orifice opening (No. 54 in FIG. 2) into the first sealing face 61. The cross sectional area of the first orifice opening 54 is preferably somewhat smaller than the cross sectional area of the cylinder bore 76, so that the rotor 31 is pressed with its second sealing face 62 against the first sealing face 61 on the sealing element 60 by the fluid pressure in the cylinder bore 76. The second sealing face 62 is matched so that it is fluid tight to the first sealing face 61, in such a way that in operation substantially no hydraulic fluid can escape from there, except for slight leakages. The various annular grooves 53 each have a constant depth extending from the first sealing face 61 in the direction of the first axis of rotation 32, the grooves running circularly around the first axis of rotation 32 (see also FIG. 2). The various annular grooves 53 each have a different circular diameter, so that they are separated fluid-tightly from one another. The annular grooves 53 are each open towards the assigned orifice opening 54, so that hydraulic fluid can flow from the first fluid duct portion 55 via the assigned orifice opening 54 into the assigned annular groove 53, and vice versa. A second fluid duct portion 56, which is embodied as a fluid line, which at least in parts is formed as a pipe or as a pressure hose, is in each case connected to the annular groove 53. If the sealing element 60, as here, is formed as a separate sealing plate, the second fluid duct portion comprises a first bore 64, which passes through the sealing element 60 from the base of the annular groove 53 concerned in the direction of the first axis of rotation 32.

As already mentioned, the present pulse generator 30 is embodied as a closed hydraulic circuit. Due to leakages, hydraulic fluid is able to escape from this closed circuit. This is preferably continuously replaced, in order to allow faultless operation of the pulse generator 30. For this purpose, a separate feed pump 73 is provided, which may be embodied as a gear pump, for example, drawing hydraulic fluid from a tank 75. All second fluid duct portions 56 are connected in parallel, each via an assigned non-return valve 74, to the delivery side of the feed pump 73. The non-return valve 74 is fitted so that in each case only one fluid flow can ensue from the feed pump 73 to the respectively assigned second fluid duct portion 56, but not in the opposite direction. The design delivery pressure of the feed pump 73 is preferably so low that the latter can deliver fluid solely into those second fluid duct portions 56 which are assigned to each of the defining elements 71 extending out of the rotor 31.

Figure 2:
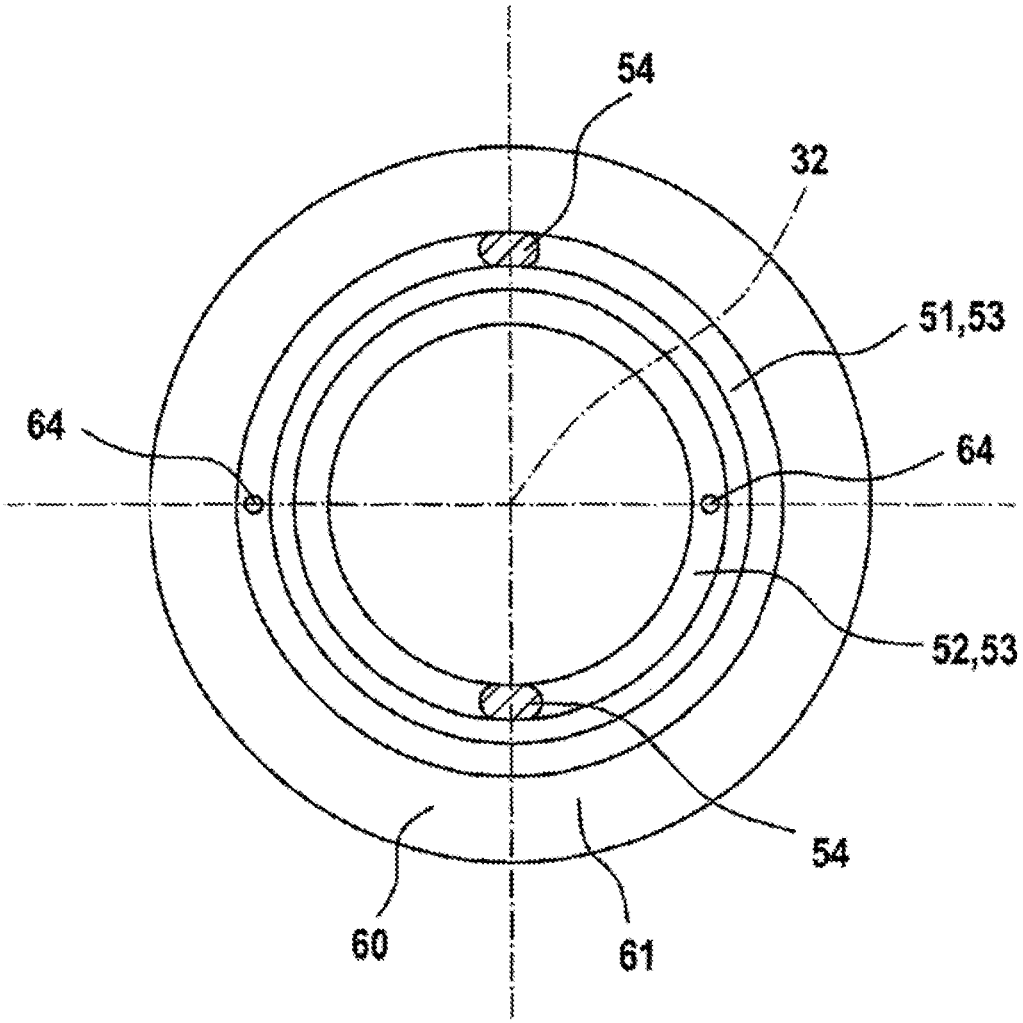
FIG. 2 shows a front view of the sealing element according to FIG. 1.

FIG. 2 shows a front view of the sealing element 60 according to FIG. 1, the first sealing face 61 being visible. The annular grooves 53, each running circularly around the first axis of rotation 32, are arranged in the first sealing face 61. The first bore 64 already mentioned, which is an integral part of the second fluid duct portion, in each case opens out at the base of each annular groove 53. The various first bores 64 are preferably arranged at different points around the first axis of rotation 32, so that they are spaced at an interval from one another sufficiently large enough for connection of the remainder of the second fluid duct portion. Moreover, the position of the first bores 64 is freely selectable around the circumference of the annular groove 53 concerned.

Also entered in FIG. 2 are the orifice openings 54, already mentioned, of the first fluid duct portions 55. For the sake of clarity, a rotor position turned through 90° compared to FIG. 1 has been assumed, so that the orifice openings 54 do not cover the first bores 64. The orifice openings 54 are each of elongated formation, preferably following the circular profile of the assigned annular groove 53. The width of the orifice openings 54 in a radial direction relative to the first axis of rotation 32 is substantially equal to the width of the annular groove 53 concerned, the orifice opening preferably being arranged centrally over the assigned annular groove 53. All annular grooves 53 are preferably of equal width.

Figure 3:
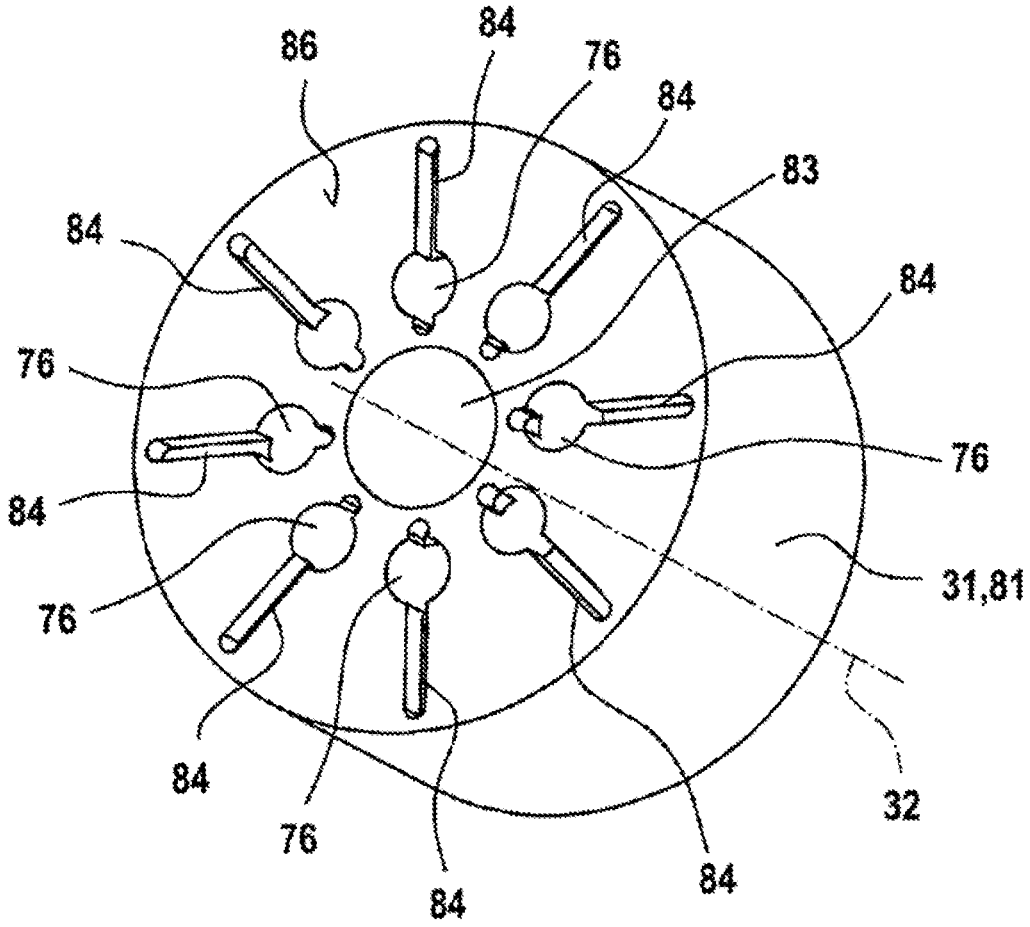
FIG. 3 shows a perspective view of a first rotor part according to a second embodiment of the disclosure.

FIG. 3 shows a perspective view of a first rotor part 81 according to a second embodiment of the disclosure. The second embodiment is identical to the first embodiment, except for the differences described below, the same or corresponding parts being provided with the same reference numerals in FIGS. 3 and 4, and in FIGS. 1 and 2 respectively.

The second embodiment differs from the first embodiment primarily in that the annular grooves 53 are arranged on the rotor 31. A further difference is that there are more, for example eight, cylinder bores 76, so that correspondingly more annular grooves 53 are required, which take up a corresponding amount of space in a radial direction.

The rotor 31 comprises a first rotor part 81, which is embodied as a cylindrical drum. At the center the first rotor part 81 has a locating bore 83, which is designed for the rotationally fixed mounting of a separate drive shaft. Here a total of eight circular cylindrical bores 76, which are arranged parallel to the first axis of rotation 32, are arranged around the first axis of rotation 32. The cylindrical bores 76 are covered at the end face by the second rotor part (no. 82 in FIG. 4), on which the annular grooves 53 are arranged.

Each cylindrical bore 76 is crossed by an assigned groove 84 running radially to the first axis of rotation 32, so that hydraulic fluid can flow from the cylindrical bore 76 into the assigned radial groove 84, and vice-versa. The radial grooves 84 preferably each have a constant depth and a constant width. Their length in a radial direction is here identical, but they may also be formed differently depending on the position of the annular groove concerned.

The outer circumferential face of the first rotor part 81 is circular-cylindrical relative to the first axis of rotation 32. The cylindrical bores 76 and the radial grooves each open into a first bearing face 86 on the first rotor part 81. The first bearing face 86 is a plane face and is arranged perpendicular to the first axis of rotation 32.

Figure 4:
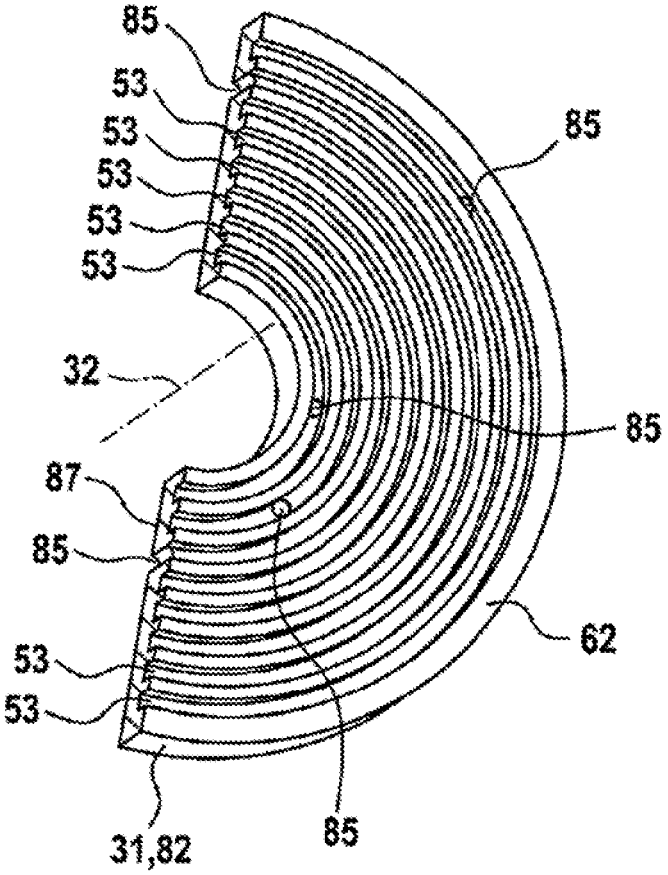
FIG. 4 shows a perspective sectional view of a second rotor part of the second embodiment of the disclosure.

FIG. 4 shows a perspective sectional view of a second rotor part 82 of the second embodiment of the disclosure. The corresponding plane of section is selected so that it contains the first axis of rotation 32. The second rotor part 82 bears with its plane second bearing face 87 on the first bearing face (No. 86 in FIG. 3) of the first rotor part, being fixedly connected to the latter. The plane second sealing face 62 is arranged on the side of the second rotor part 82 remote from the second bearing face 87 and is arranged parallel to the second bearing face 87.

Here a total of eight annular grooves 53 are provided in the second sealing face 62, so that an annular groove 53 is assigned to each cylinder bore (No. 76 in FIG. 3). The annular grooves 53 are again formed circularly relative to the first axis of rotation 32, their depth being constant in the direction of the first axis of rotation 32. A second bore 85, which passes through the second rotor part 82 in the direction of the first axis of rotation 32, in each case opens into the base of each annular groove 53. The second bore 85 in each case opens into an assigned radial groove (No. 84 in FIG. 3) on the opposite side of the second rotor part 82, so that each cylinder bore (No. 76 in FIG. 3) has a fluid connection to an assigned annular groove 53.

Unlike the first embodiment, there are no annular grooves on the sealing element, where now only the first bores (No. 64 in FIGS. 1,2) are arranged, which now each open into an assigned annular groove 53 on the second rotor part 82.

Figure 5:
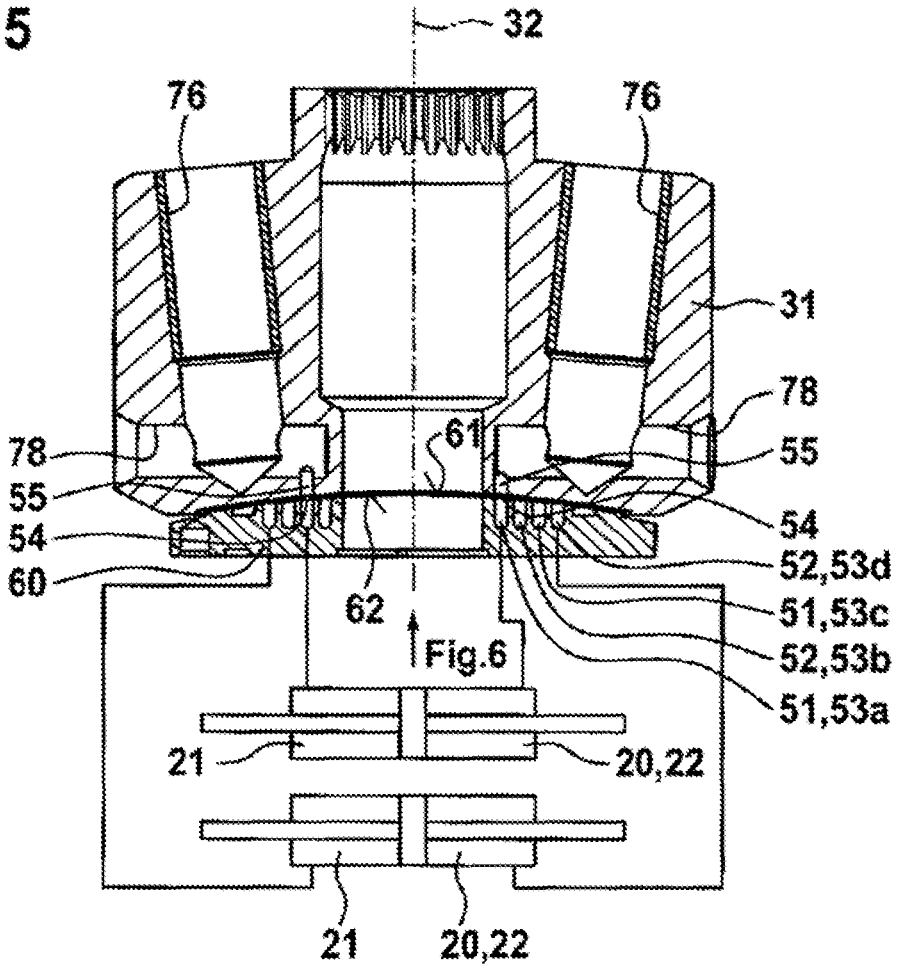
FIG. 5 shows a sectional view of a rotor and a sealing element according to a third embodiment of the disclosure.

FIG. 5 shows a sectional view of a rotor 31 and a sealing element 60 according to a third embodiment of the disclosure. The third embodiment is identical to the first embodiment, except for the differences described below, so that reference is made to the explanations of FIG. 1 concerning this. The same or corresponding parts are provided with the same reference numerals in FIGS. 1 and 5.

In the third embodiment two actuators 20 are provided, there being a total of eight cylinder bores 76 in the rotor 31. Accordingly, a total of four cylinder bores 76 are assigned to each actuator 20. The cylinder bores 76 are arranged in the rotor 31, uniformly distributed around the first axis of rotation 32, the bores here each comprising a separate, optional cylinder liner 79, which is composed of brass, for example. A first rotary passage 51 and a second rotary passage 52, which each have an annular groove 54*a;* 54*b;* 54*c;* 54*d,* are assigned to each of the two actuators 20. The annular grooves 54*a;* 54*b;* 54*c;* 54*d* are arranged concentrically with one another in the first sealing face 61 on the sealing element 60. The first sealing face 61 and the second, matched sealing face 62 here are of spherical design. The annular grooves 54*a;* 54*b;* 54*c;* 54*d* here are arranged with a radially inward offset relative to the cylinder bores 76. The first fluid duct portion 55 comprises a transverse bore 78, which is oriented perpendicular to the first axis of rotation 32, the bore being closed radially outside by a cap (not shown). The transverse bores 78 each intersect an assigned cylinder bore 76, the orifice openings 54 each opening into an assigned transverse bore 78.

One actuator 20 is connected to the two radially inner annular grooves 54*a;* 54*b*, the other actuator 20 being connected to the two radially outer annular grooves 54*c*; 54*d*. Each actuator 20 here is connected to two immediately adjacent annular grooves 54*a*; 54*b;* 54*c*; 54*d*.

Figure 6:
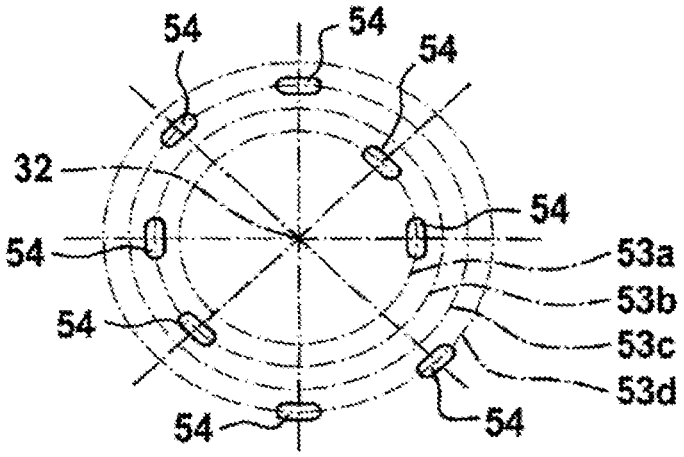
FIG. 6 shows a front view of the orifice opening of the third embodiment of the disclosure.

FIG. 6 shows a front view of the orifice opening 54 of the third embodiment of the disclosure. The corresponding viewing direction is entered in FIG. 5. In FIG. 6 only the orifice openings 54 are shown, the remainder of the rotor being omitted. The position of each of the annular grooves 54*a;* 54*b;* 54*c;* 54*d* is identified by dot-and-dash lines. Altogether one orifice opening 54 is provided for each cylinder bore (No. 76 in FIG. 5), so that there is a total of eight orifice openings 54. The orifice openings 54 are arranged at uniform angular intervals around the first axis of rotation 32. The orifice openings 54 are each of reniform shape, so that they have a large open cross sectional area. Their width in a radial direction is equal to the width of the annular groove 54*a;* 54*b;* 54*c;* 54*d* concerned and they are arranged in alignment with the latter. Each two immediately adjacent orifice openings in a circumferential direction relative to the first axis of rotation 31 are connected to the same annular groove 54*a;* 54*b;* 54*c;* 54*d*. Orifice openings 54 and cylinder bores at 180° opposite one another relative to the first axis of rotation 32 are connected to different first or second cylinder chambers (No. 21; 22 in FIG. 5) of the same actuator. As a result, succeeding pairs of pistons in a circumferential direction are alternately assigned to the outside and inside of the annular grooves 54*a;* 54*b;* 54*c*; 54*d*.

REFERENCE NUMERALS

10 vibratory drive
20 actuator
21 first fluid chamber
22 second fluid chamber
23 piston
24 piston rod
25 housing of the actuator
30 pulse generator
31 rotor
32 first axis of rotation
33 third fluid chamber
34 fourth fluid chamber
35 drive shaft
36 housing
37 pivot bearing
38 drive journal
39 interior space
40 swash plate
41 second axis of rotation
42 swiveling cylinder
51 first rotary passage
52 second rotary passage
53 annular groove
53*a* annular groove
53*b* annular groove
53*c* annular groove
53*d* annular groove
54 orifice opening
55 first fluid duct portion
56 second fluid duct portion
60 sealing element
61 first sealing face
62 second sealing face
63 fixed connection between sealing element and housing
64 first bore
70 coupling element
71 defining element
72 axial piston pump
73 feed pump
74 non-return valve
75 tank
76 cylinder bore
77 coupling face
78 transverse bore
79 cylinder liner
81 first rotor part
82 second rotor part
83 locating bore
84 radial groove
85 second bore
86 first bearing face
87 second bearing face

What is claimed is:

1. A vibratory drive, comprising:

at least one actuator with a first fluid chamber and a second fluid chamber, the volumes of the first and second fluid chambers being adjustable in phase opposition; and a pulse generator having at least one third fluid chamber and at least one fourth fluid chamber therein, the first fluid chamber having a fluid connection to the third fluid chamber and the second fluid chamber having a fluid connection to the fourth fluid chamber, the third fluid chamber and the fourth fluid chamber each in portions being defined by linearly moveable defining elements, wherein the pulse generator includes a rotor that is configured to rotate relative to a first axis of rotation and that defines respective portions of the third fluid chamber and the fourth fluid chamber, the defining elements accommodated so as to be linearly moveable in the rotor, wherein the pulse generator further includes a coupling element separate from the rotor, the defining elements coupled in their movement to that of the coupling element, wherein a first rotary passage and a second rotary passage in the pulse generator are assigned to each actuator, each first rotary passage affording a fluid connection from the first fluid chamber concerned to the third fluid chamber concerned, each second rotary passage affording a fluid connection from the second fluid chamber concerned to the fourth fluid chamber concerned, wherein the first rotary passage and the second rotary passage each include an annular groove that runs circularly around the first axis of rotation, an orifice opening that opens into the annular groove is arranged on another part of the rotary passage concerned, and wherein all first rotary passages and all second rotary passages have a common sealing element, a first sealing face that bears and slides on a second sealing face on the rotor is arranged on the sealing element, and wherein the annular grooves are arranged in the one first sealing face or the one second sealing face, the orifice openings arranged in the other, second or first sealing face.

2. The vibratory drive according to claim 1, wherein the position of the coupling element is adjustable relative to the first axis of rotation.

3. The vibratory drive according to claim 1, wherein the pulse generator is configured as an axial piston pump, the defining elements formed by pistons moving substantially parallel to the first axis of rotation.

4. The vibratory drive according to claim 3, wherein the axial piston pump is of swash-plate type, the coupling element formed by a swash plate that is configured to pivot relative to a second axis of rotation, the second axis of rotation oriented perpendicular to the first axis of rotation.

5. The vibratory drive according to claim 1, wherein the volumes of the third fluid chamber and the fourth fluid chamber, which are assigned to the same actuator, are adjustable in phase opposition by the rotation of the rotor.

6. The vibratory drive according to claim 1, wherein the sealing ring is an integral part of all first rotary passages and all second rotary passages.

7. The vibratory drive according to claim 1, wherein the third fluid chamber and the fourth fluid chamber each have a fluid connection to an assigned first fluid duct portion that runs in the rotor and that leads to the assigned rotary passage.

8. The vibratory drive according to claim 1, wherein the at least one actuator is two actuators, to each of which a separate first rotary passage and a separate second rotary passage are assigned, all rotary passages each having an annular groove, all annular grooves arranged concentrically with one another, two immediately adjacent annular grooves being assigned to each actuator.

9. The vibratory drive according to claim 1, wherein the number of third fluid chambers and fourth fluid chambers is in each case a whole-number multiple, greater than one, of the number of actuators, adjacent third fluid chambers in a circumferential direction relative to the first axis of rotation being assigned to the same actuator, adjacent fourth fluid chambers in a circumferential direction relative to the first axis of rotation being assigned to the same actuator.

10. A vibratory drive, comprising:

at least one actuator with a first fluid chamber and a second fluid chamber, the volumes of the first and second fluid chambers being adjustable in phase opposition; and a pulse generator having at least one third fluid chamber and at least one fourth fluid chamber therein, the first fluid chamber having a fluid connection to the third fluid chamber and the second fluid chamber having a fluid connection to the fourth fluid chamber, the third fluid chamber and the fourth fluid chamber each in portions being defined by linearly moveable defining elements, wherein the pulse generator includes a rotor that is configured to rotate relative to a first axis of rotation and that defines respective portions of the third fluid chamber and the fourth fluid chamber, the defining elements accommodated so as to be linearly moveable in the rotor, wherein the pulse generator further includes a coupling element separate from the rotor, the defining elements coupled in their movement to that of the coupling element, and wherein the at least one actuator is two actuators, to each of which a separate first rotary passage and a separate second rotary passage are assigned, all rotary passages each having an annular groove, all annular grooves arranged concentrically with one another, two immediately adjacent annular grooves being assigned to each actuator.

* * * * *